US011268289B2

(12) United States Patent
Bond

(10) Patent No.: US 11,268,289 B2
(45) Date of Patent: Mar. 8, 2022

(54) DROPHEAD NUT FOR FORMWORK GRID SYSTEMS

(71) Applicant: BOND FORMWORK SYSTEMS, LLC, Wa, TX (US)

(72) Inventor: Bradley D. A. Bond, Waller, TX (US)

(73) Assignee: BOND FORMWORK SYSTEMS, LLC, Waller, TX (US)

( * ) Notice: Subject to any disclaimer, the term of this patent is extended or adjusted under 35 U.S.C. 154(b) by 0 days.

(21) Appl. No.: 16/944,483

(22) Filed: Jul. 31, 2020

(65) Prior Publication Data

US 2022/0034103 A1 Feb. 3, 2022

(51) Int. Cl.
*E04G 11/48* (2006.01)
*E04G 17/04* (2006.01)

(52) U.S. Cl.
CPC ..... *E04G 11/486* (2013.01); *E04G 17/04* (2013.01)

(58) Field of Classification Search
CPC ..... E04G 11/486; E04G 11/483; E04G 11/48
USPC ..... 411/435, 427, 366.1
See application file for complete search history.

(56) References Cited

U.S. PATENT DOCUMENTS 337,601 A 3/1886 Merrill
812,294 A * 2/1906 Reed ..... F16B 37/16 411/435
1,078,007 A * 11/1913 Stange ..... F16B 13/141 52/704
1,382,505 A 6/1921 Hargey
1,781,063 A 11/1930 Jessen
1,919,728 A * 7/1933 Kellogg ..... F16B 37/16 411/435
2,010,848 A 8/1935 Dix
2,064,921 A * 12/1936 Kinsella ..... D01H 1/06 403/104
2,067,773 A * 1/1937 Long ..... F16L 19/0206 411/435

(Continued)

FOREIGN PATENT DOCUMENTS

CA 2698537 A1 3/2008
CN 101864835 A * 10/2010 ..... E04G 11/486

(Continued)

OTHER PUBLICATIONS

DIN EN ISO 9001, "Slab forming system Ischebeck HV" brochure, USA/HV/LI/11.2009, 12 pages.

(Continued)

*Primary Examiner* — Michael Safavi
(74) *Attorney, Agent, or Firm* — Nolte Lackenbach Siegel

(57) ABSTRACT

A drophead nut for use with formwork building components is disclosed. The disclosed drophead nut maintains standard outward dimensions to allow interoperability with existing systems. The hitting surface of the drophead nut is typically used to align a gap in the nut with a retention pin and thus allow the nut to drop. This in turn allows a mid-plate to fall releasing pressure on a beam (joist and/or main) to allow that beam to be removed. The impact surface of the disclosed drophead nut has been enlarged, reinforced, and possibly repositioned to increase leverage. The resulting drophead nut may allow for reduction in number of impacts on an impact surface to provide alignment of the gap and retention pin, and thus activate compression of the drophead nut.

20 Claims, 11 Drawing Sheets

(56) References Cited

U.S. PATENT DOCUMENTS

| | | | | |
|---|---|---|---|---|
| 3,016,116 | A | 1/1962 | Clevenger | |
| 3,037,590 | A | 6/1962 | Pavalecka | |
| 3,176,807 | A | 4/1965 | Pavalecka | |
| 3,184,013 | A | 5/1965 | Pavalecka | |
| 3,409,266 | A | 11/1968 | Jennings | |
| 3,562,970 | A | 2/1971 | Schwartz | |
| 3,668,827 | A | 6/1972 | Schwartz | |
| 3,822,850 | A | 7/1974 | Elias | |
| 3,862,530 | A | 1/1975 | Martine | |
| 4,034,957 | A | 7/1977 | Cody | |
| 4,122,645 | A | 10/1978 | Tooley | |
| 4,156,999 | A | 7/1979 | Avery | |
| 4,159,604 | A | 7/1979 | Burrell | |
| 4,333,289 | A | 6/1982 | Strickland | |
| 4,441,300 | A | 4/1984 | Varon | |
| 4,492,358 | A | 1/1985 | Manderla | |
| 4,679,007 | A | 7/1987 | Reese et al. | |
| 5,031,724 | A | 7/1991 | Quinn | |
| 5,064,325 | A * | 11/1991 | McRoskey | F16B 37/16 411/368 |
| 3,026,977 | A | 3/1992 | Pollock | |
| 5,175,472 | A | 12/1992 | Johnson, Jr. et al. | |
| 5,195,045 | A | 3/1993 | Keane et al. | |
| 5,233,807 | A | 8/1993 | Spera | |
| 5,307,596 | A | 5/1994 | Bockmiller | |
| 5,394,061 | A | 2/1995 | Fujii | |
| 5,579,624 | A | 12/1996 | Aeberhard | |
| 5,590,863 | A | 1/1997 | Sasaki | |
| 5,743,058 | A | 4/1998 | Boomsma | |
| 5,758,854 | A | 6/1998 | Shih | |
| 5,996,299 | A | 12/1999 | Hsueh | |
| 6,209,275 | B1 | 4/2001 | Cates | |
| 6,260,321 | B1 | 7/2001 | Rudduck | |
| 6,481,912 | B2 | 11/2002 | Shih | |
| 6,612,533 | B2 | 9/2003 | Biles et al. | |
| 7,578,110 | B2 | 8/2009 | Jenkins | |
| 7,584,932 | B2 | 9/2009 | Shih | |
| 8,066,247 | B2 | 11/2011 | Spera | |
| 8,307,607 | B2 | 11/2012 | Conterno | |
| 8,616,519 | B2 | 12/2013 | Bacon | |
| 8,820,018 | B2 | 9/2014 | Maley | |
| 9,004,443 | B2 | 4/2015 | Zhang | |
| 10,024,069 | B2 | 7/2018 | Bond et al. | |
| 10,053,875 | B1 | 8/2018 | Baron | |
| 10,053,877 | B2 | 8/2018 | Lenkin | |
| 10,590,665 | B2 | 3/2020 | Lenkin | |
| 2007/0264076 | A1 | 11/2007 | McCracken | |
| 2012/0042600 | A1* | 2/2012 | Bacon | E04G 11/486 52/632 |
| 2014/0263941 | A1 | 9/2014 | Zhang | |
| 2016/0060882 | A1 | 3/2016 | Bond | |
| 2018/0080238 | A1 | 3/2018 | Lenkin | |
| 2018/0187437 | A1 | 7/2018 | Chevis | |
| 2018/0258657 | A1 | 9/2018 | Chevis | |
| 2018/0340342 | A1 | 11/2018 | Lizarazu et al. | |
| 2019/0010717 | A1 | 1/2019 | Baron | |
| 2019/0127996 | A1 | 5/2019 | Chevis | |
| 2019/0145115 | A1* | 5/2019 | Bacon | E04G 5/16 52/127.2 |
| 2019/0194961 | A1* | 6/2019 | Bond | E04G 11/38 |
| 2020/0102764 | A1* | 4/2020 | Bacon | E04G 5/16 |

FOREIGN PATENT DOCUMENTS

| | | | | | |
|---|---|---|---|---|---|
| CN | 102797353 | | | 11/2012 | |
| CN | 204126259 | U | * | 1/2015 | E04G 11/486 |
| CN | 108868126 | A | * | 11/2018 | E04G 11/483 |
| DE | 2927116 | A1 | * | 1/1981 | E04G 11/486 |
| DE | 3147081 | A1 | * | 12/1982 | E04G 11/486 |
| DE | 3316557 | C1 | | 11/1984 | |
| DE | 4204773 | A1 | * | 8/1993 | E04G 11/486 |
| DE | 102006055306 | A1 | * | 5/2008 | E04G 11/486 |
| EP | 1847665 | | | 10/2007 | |
| EP | 2749713 | A1 | | 7/2014 | |
| EP | 3202998 | A1 | * | 8/2017 | E04G 11/38 |
| FR | 2508958 | | * | 1/1983 | E04G 11/486 |
| FR | 2497862 | A1 | | 10/2007 | |
| FR | 2900176 | A1 | * | 10/2007 | E04G 11/486 |
| FR | 2916466 | A1 | * | 11/2008 | E04G 11/486 |
| FR | 2923241 | A1 | | 5/2009 | |
| FR | 3021985 | | * | 12/2015 | E04G 11/486 |
| GB | 1457136 | | | 3/1974 | |
| GB | 2090901 | | | 7/1982 | |
| GB | 2099902 | | | 12/1982 | |
| GB | 2127886 | A | * | 4/1984 | E04G 25/065 |
| GB | 2054691 | | | 2/1991 | |
| JP | 08042163 | A | | 2/1996 | |
| KR | 20090076813 | A | | 7/2009 | |
| WO | 2017134135 | A1 | | 8/2017 | |
| WO | 2019156958 | A1 | | 8/2019 | |
| WO | 2009009898 | A1 | | 1/2020 | |
| WO | 2020083935 | A1 | | 4/2020 | |

OTHER PUBLICATIONS

TITAN HV Slab Forming System, Concrete Support Systems www.concretesupportusa.com, Oct. 2010 74 pages.

* cited by examiner

DROPHEAD NUT FOR FORMWORK GRID SYSTEMS

CROSS REFERENCE TO RELATED APPLICATIONS

This Application is related to concurrently filed Application for US Patent, entitled, "SECONDARY JOIST PROFILE FOR GRID SYSTEMS," by Bradley Bond, having application Ser. No. 16/944,473, which is incorporated by reference herein for all applicable purposes. This Application is also related to concurrently filed Application for US Patent, entitled, "MAIN BEAM PROFILE FOR GRID SYSTEMS," by Bradley Bond, having application Ser. No. 16/944,468, which is incorporated by reference herein for all applicable purposes.

BACKGROUND

Formwork is a type of construction material used in the construction of buildings and other types of architecture projects that typically include concrete sections (e.g., walls, floors). Formwork is provided in a modular set of components to provide support structure during construction and may be temporary or permanent. Temporary formwork is the focus of this disclosure and differs from permanent formwork at least because temporary formwork is used during the construction process and does not become part of the completed structure (i.e., permanent). Formwork is generally used to assist in creating a "form" into which concrete may be poured and then allowed to "set" into hardened concrete. One typical use for temporary formwork is to support different layers of a building while concrete floors are poured for each layer (e.g., floor of the building or structure).

In one example, formwork may be used to create a grid system to support a roof or ceiling of an already finished floor while the next higher floor is poured. The grid system includes support props (sometimes called "posts" or "shores") that hold main beams. The main beams, in turn are spanned by joists (e.g., perpendicular to the main beams). The joists support a decking material (usually plywood) onto which cement may be poured and allowed to set. In this manner, a building may be constructed from the ground up, one floor at a time. As each layer is built, temporary formwork from a previous layer may be removed (after the cement has sufficiently cured) and relocated to a higher floor to repeat the process of building each layer for subsequent floors of the structure.

At the top of each prop is a drophead nut that when engaged (i.e., expanded) holds the main beam at a desired height. Upon disengagement of the supporting mid-plate (i.e., compression), the drophead nut releases and allows removal of associated main beams and the joists. This disclosure presents multiple aspects of an improved drophead nut that remains interoperable with existing formwork grid systems.

BRIEF DESCRIPTION OF THE DRAWINGS

The present disclosure may be better understood from the following detailed description when read with the accompanying Figures. It is emphasized that, in accordance with standard practice in the industry, various features are not drawn to scale. In fact, the dimensions or locations of functional attributes may be relocated or combined based on design, structural requirements, building codes, or other factors known in the art of construction. Further, example usage of components may not represent an exhaustive list of how those components may be used alone, or with respect to each other. That is, some components may provide capabilities not specifically described in the examples of this disclosure but would be apparent and known to those of ordinary skill in the art, given the benefit of this disclosure. For a detailed description of various examples, reference be made below to the accompanying drawings, in which.

DETAILED DESCRIPTION

Figure 1:
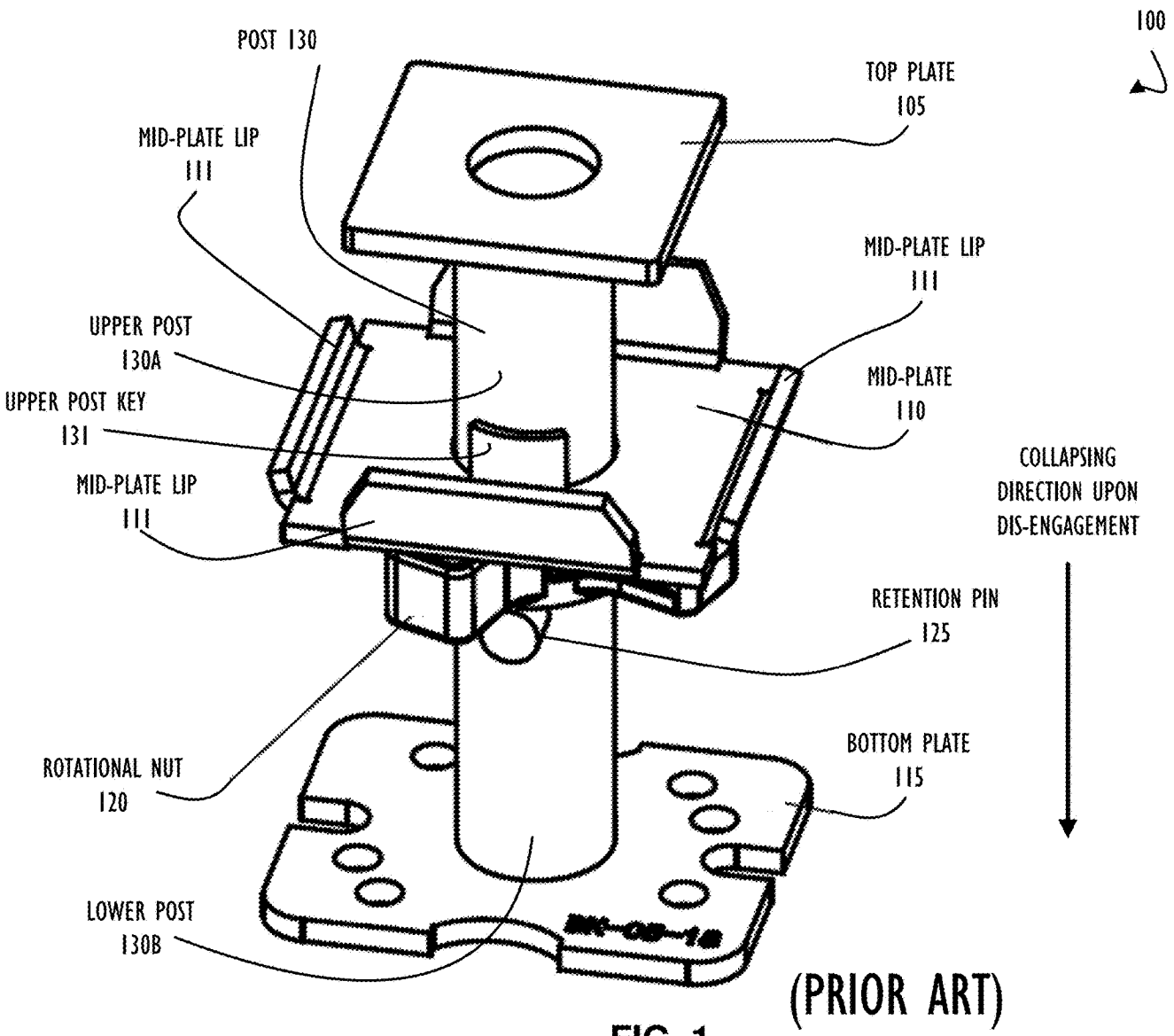
FIG. 1 (PRIOR ART)
FIG. 1 illustrates elements of a prior art drophead nut.

Illustrative examples of the subject matter claimed below will now be disclosed. In the interest of clarity, not all features of an actual implementation are described for every example implementation in this specification. It will be appreciated that in the development of any such actual example, numerous implementation-specific decisions may be made to achieve the designers' specific goals, such as compliance with architectural and building code constraints, which will vary from one usage to another.

Disclosed herein is a drophead nut for use with formwork building components. The disclosed drophead nut maintains standard outward dimensions to allow interoperability with existing systems (i.e., other existing formwork components). The impact surface of the drophead nut is typically used to align a gap in the nut with a retention pin and thus allow the nut to drop. This, in turn, allows a mid-plate of the drophead nut to fall and release components supported therefrom. In most cases, these components will include main beams and/or joists (secondary beams). In its extended position, the drophead connects to a post at a desired height to support a set of main beams and joists that in turn support a decking to receive wet cement or concrete.

Once the cement or concrete is cured, the drophead nut may be disengaged (i.e., released) to allow removal of support structures and allow stripping the decking from below. The impact surface of the disclosed drophead nut has been enlarged, reinforced, and possibly repositioned to increase leverage. The resulting drophead nut may allow for reduction in number of impacts on an impact surface to provide alignment of a gap and retention pin, and thus activate the compression of the drophead nut. In some embodiments, the retention pin of the disclosed drophead nut has also been substantially strengthened. A strengthened retention pin allows a mid-plate to support more weight while the drophead nut is in its engaged position.

The above referenced additional capacity of the drophead nut may work in conjunction with improved main beams and secondary beams to create grid systems that have larger grids than traditional systems. For example, grid systems may be increased from their traditional six foot by six foot size and be increased to six foot by eight foot, eight foot by eight foot, or even larger grid sizes. As explained in more detail below, each increase in grid size typically allows for a reduction in total number of components utilized to create a formwork grid system for an area of construction (e.g., square footage of concrete pour). Specific test measurements for different example implementations are provided as an appendix to this Specification.

In general, formwork may be used to support portions of a building itself while the building is being constructed. Formwork may include multiple components that are modular. Each of the components provides specific capabilities and when used together with other formwork components may provide appropriate support characteristics as required for the building's construction parameters (e.g., thickness of slab, placement of permanent support columns). Formwork differs from scaffolding (another type of componentized construction material) in several ways. In particular, scaffolding is designed to provide safety and support for workers, equipment, and combinations thereof during a construction project. In contrast, formwork provides appropriate support characteristics for portions of the structure being built.

Accordingly, the design specifications, requirements, and other characteristics of scaffolding differ greatly from those of formwork. For example, formwork will support orders of magnitude more weight than scaffolding and scaffolding may be designed to wrap the external facade of a building rather than be internal to the building. There are also other differences between scaffolding and formwork that are known to those in the art.

Grid systems generally refers to the set of components of formwork used to create a grid to support decking material such that concrete may be poured to form the floor immediately above the working area of the grid system. For example, a grid system on the ground floor (e.g., foundation) of a building would be installed on that ground floor to support pouring of concrete to create the floor of the second story of the building (or possibly the roof of a one-story building). Once the floor of the second story has cured, the grid system may be disassembled and relocated to the newly built floor to support pouring of the third story. This process may be repeated as many times as there are floors (i.e., stories) of the building.

Grid systems include, among other components, shores, or posts, to provide vertical support, main beams to provide lateral support across the shores, and joists that span across main beams to provide support for a decking material. In formwork terminology, joists may be referred to as "secondary beams," "secondary joists," or some other term to distinguish them as the spanning support (above the main beams) for the sheathing or decking material. This disclosure provides information regarding an improved drophead nut to make installation and removal of formwork components more efficient.

Referring now to FIG. 1, a prior art drophead nut 100 is illustrated. In this example, drophead nut 100 is shown in an "engaged" position. At the top of drophead nut 100 is top plate 105. Top plate 105 is positioned above upper post portion 130A which is a continuation of lower post portion 130B shown lower in this representation. Together, upper post portion 130A and lower post portion 130B form a single contiguous post 130. Drophead nut 100 has bottom plate 115 at its base with the post 130 (i.e., including both lower post portion 130B and upper post portion 130A) disposed between bottom plate 115 and top plate 105.

In the midpoint of drophead nut 100, several components are shown that are either attached to or allowed to freely rotate about post 130. Upper post key 131 is a protrusion from upper post portion 130A that fits into a slot on mid-plate 110 (an example slot is shown in FIG. 3) to prevent rotation of mid-plate 110 around post 130. When mid-plate 110 is not engaged with upper post key 131 (i.e., in a "collapsed" position), mid-plate 110 is free to rotate freely around post 130. The midpoint of drophead nut 100 also includes rotational nut 120 and retention pin 125 that function together to maintain an engaged position or allow for drophead nut 100 to have a collapsed position (i.e., upon disengagement of rotational nut 120 and retention pin 125).

Figure 4A:
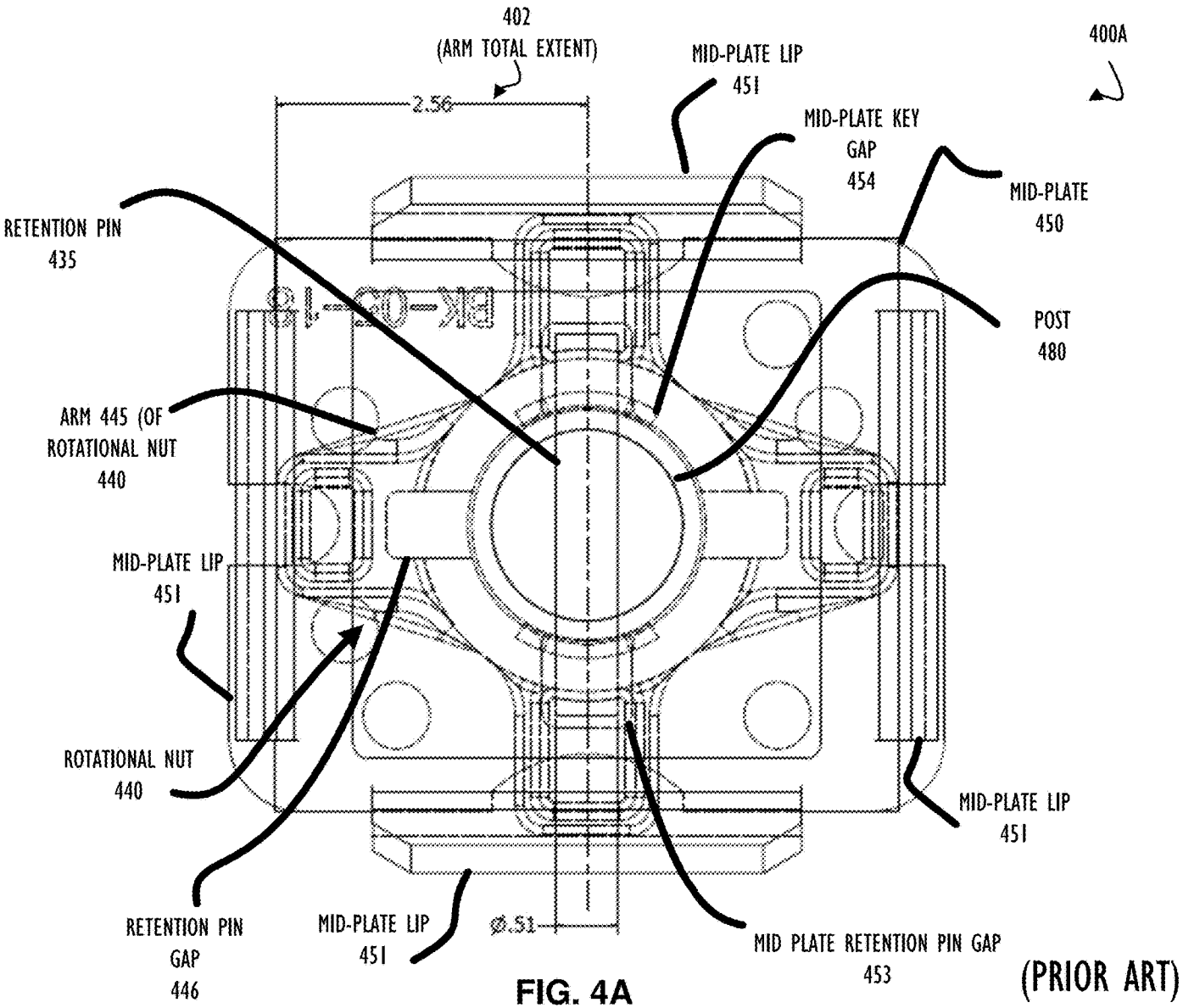
FIG. 4A (PRIOR ART)
FIG. 4A illustrates a multi-layer view illustrating internal component interactions of the drophead nut of FIG. 1.

Concurrently referencing FIGS. 1 and 4A (FIG. 4A illustrates a see-through view 400A from above), rotational nut 440 (similar in function to rotational nut 120 of FIG. 1) has a retention pin gap 446 that, upon alignment with retention pin 435 (similar in function to retention pin 125 of FIG. 1), will allow rotational nut 440 to drop toward bottom plate 165. That is, when aligned for disengagement, rotational nut 440 will pass over retention pin 435 (125 in FIG. 1), with retention pin 435 passing through the retention pin gap 446, and rotational nut 440 will slide down post 130 over lower post portion 130B toward bottom plate 115. Also, because rotational nut 440 is providing upward support for mid-plate 450 (110 in FIG. 1), upon disengagement of rotational nut 450, mid-plate 450 will similarly fall toward bottom plate 165. As illustrated by a slightly larger dashed outline than retention pin gap 446 in FIG. 4A, mid-plate 450 also has a mid-plate retention pin gap 453 (illustrated as dashed line in FIG. 4A) that allows mid-plate 450 (110 in FIG. 1) to pass over retention pin 435 (125 in FIG. 1). Thus, upon alignment for disengagement, both a rotational nut and a mid-plate of a given drophead nut will descend over their respective retention pin and fall toward their respective bottom plate.

As illustrated in FIG. 4A, rotational nut 440 has four "arms" 445 extending from its circular center to form a shape like an "x" or a "cross" in this example. Other numbers are arms are possible, however, for the purposes of explanation in this disclosure each rotational nut 440 is assumed to have four symmetrically positioned arms as illustrated in FIG. 4A. Accordingly, two of the four arms include at least a portion of retention pin gap 446 while the other two arms do not have any type of retention pin gap.

Returning to FIG. 1, mid-plate 110 includes, in this example, four mid-plate lips that are each identified as mid-plate lip 111. In use, (as explained in more detail with reference to FIGS. 3A-B), each mid-plate lip 111 may be connected to a main beam or joist beam to provide support for that main beam or joist beam. During construction, support is provided to the respective beam with drophead nut 100 being in an engaged position. After the cement above the grid system has cured, rotation of each rotational nut on a respective drophead nut will release support for an associated end of a beam (either joist beam or main beam). Once support for each respective beam is released, components that were supported by that main beam or joist beam (and the beam itself) may be removed and any decking material may be stripped from the cured concrete layer that has formed above this portion of the formwork grid system.

Figure 2:
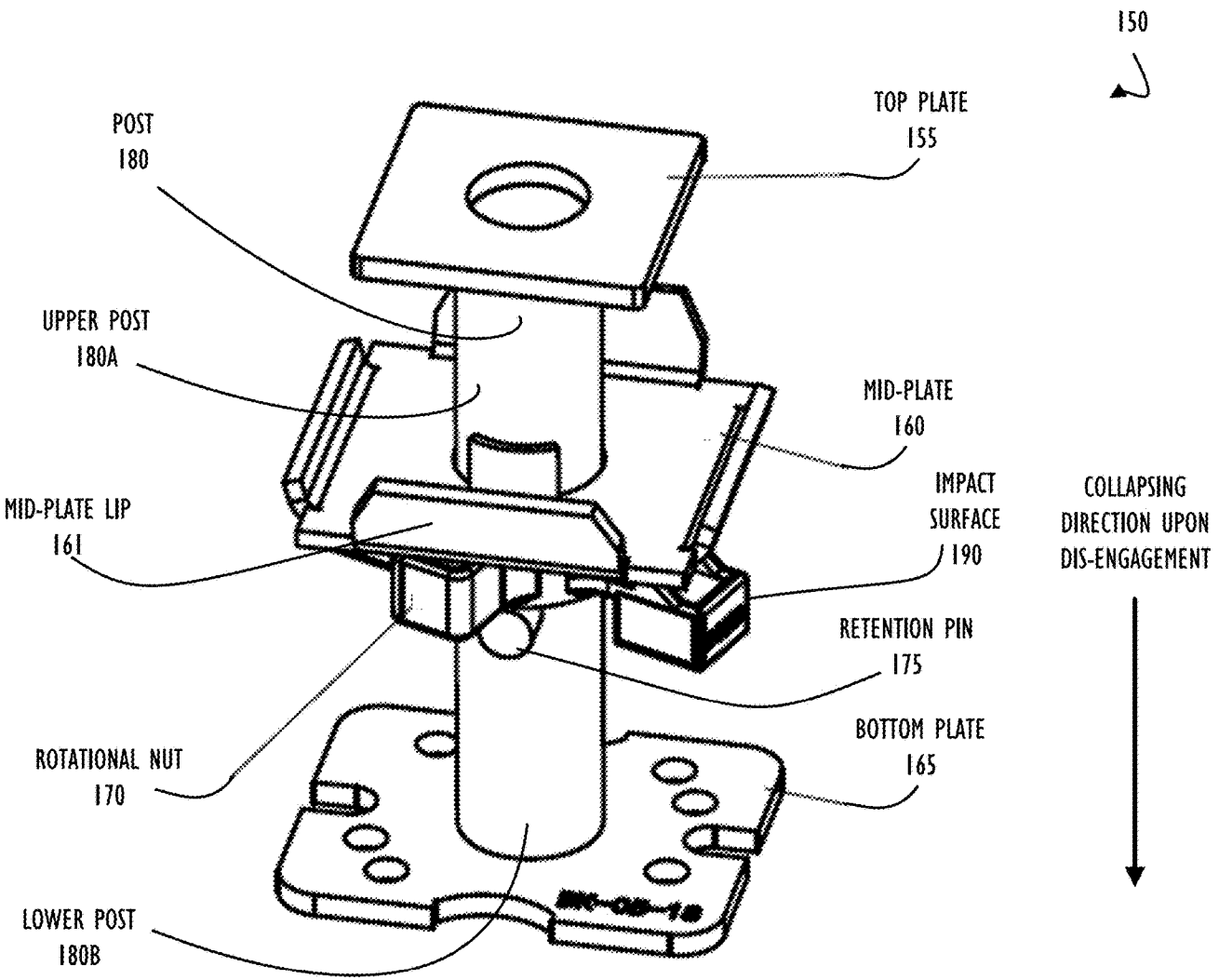
FIG. 2 illustrates elements of a drophead nut, according to one or more disclosed implementations.

Referring now to FIG. 2, drophead nut 150 has several features that are similar to and perform the same function as drophead nut 100 of FIG. 1 (i.e., it is functionally interoperable because it maintains consistent external dimensions). Notably different is impact surface 190 on rotational nut 170 that has been added. As explained further below, with reference to FIGS. 4A-C, traditional rotational nuts for a drophead nut have an impact surface consistent in extent (i.e., external dimensions) with the rotational nut itself. In contrast, impact surface 190 extends further down and in some embodiments further out (i.e., away from post 180) than the impact surface of a traditional rotational nut. By enlarging impact surface 190, the area is easier to hit (i.e., with a hammer) when moving drophead nut 150 from its disengaged position to its engaged position or when removing a grid system when under pressure as part of reshoring (i.e., disengaging drophead nut 150 from its engaged position that is under significant pressure to its disengaged position). Thus, a worker may disengage drophead nut 150 with a single hammer blow that may more easily contact impact surface 190 (or at least fewer blows than a traditional rotational nut). Because the hitting surface is larger the worker may be more willing to provide a more intense initial strike. Also, because the position of impact surface 190 has been relocated (i.e., away, and down from its prior art location) additional leverage may be achieved by each hammer blow. These factors result in an improved drophead nut over prior art implementations.

In the illustration of FIG. 2, only one impact surface 190 is visible, however, in some embodiments a symmetrical second impact surface 190 is provided opposite the one visible in FIG. 2. In other embodiments, each arm of a rotational nut may be fitted with an expanded impact surface without departing from the concepts of this disclosure. That is, a functional rotational nut in accordance with this disclosure will have at least one impact surface and may have as many as four impact surfaces (e.g., one for each arm). Also, in cases where more than four arms are implemented other numbers of impact surfaces may be provided.

As noted above, and discussed further below, the disclosed improved drophead nut has a retention pin capable of supporting significantly more weight than prior art systems. This additional support weight may, in turn, cause rotation of the rotational nut to require more force to be repositioned and disengaged. Accordingly, improvements to the impact surface work together with improvements to increase weight capacity of a drophead nut while maintaining a similar and interoperable functionality with existing formwork components. Similarly, improvements to drophead nut components may work together with improvements to joists and main beams as disclosed in the above referenced concurrently filed patent applications.

As will be explained in more detail below, disclosed embodiments of an improved drophead nut have several advantages over their prior art counterparts while maintaining a consistent external form factor to allow interchangeable use of the improved components. Prior art drophead nuts have a retention pin 125 that is 13 millimeters in diameter and a retention pin gap in the corresponding rotational nut 120 is 14 millimeters. In contrast, drophead nuts according to one disclosed embodiment have a retention pin 175 that is 18 millimeters in diameter and a retention pin gap in the corresponding rotational nut 170 is 19 millimeters. The prior art drophead nuts are designed to support six feet by six feet grid segments and have an ultimate shear strength at the retention pin of about 19 thousand pounds. In contrast, drophead nuts according to disclosed embodiments are designed to have much greater ultimate shear strengths in excess of 20 thousand pounds. In one example, ultimate shear strength may be over 49,134 pounds. As a result, improved drophead nuts, designed in accordance with this disclosure, may support grid segments that are at least eight feet by eight feet (or eight by six feet as another example). Larger grids allow for reduction of number of components of formwork grid systems to create a same sized pouring surface (e.g., slab area). Accordingly, a reduction in construction, shipping, storage, and overall simplification results in an increased productivity (efficiency) for the overall system. In some cases, the under side of a retention pin may be welded to a corresponding post to increase ultimate shear strength. Improved strength not only allows for a larger grid segment but may also allow for pouring a greater slab thickness on top of the decking material.

Figure 3A:
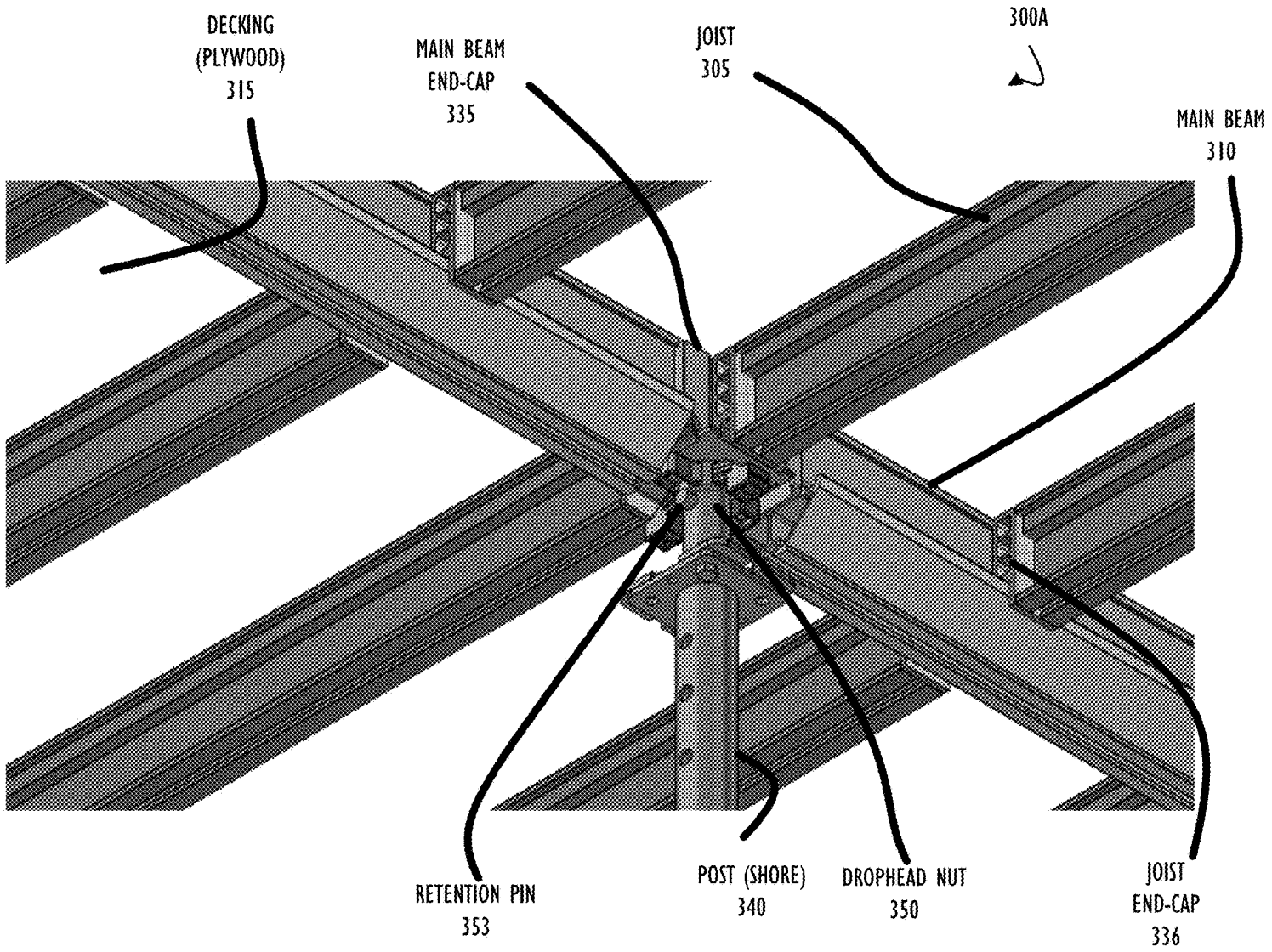
FIG. 3A illustrates a portion of an assembled grid system including a drophead nut and its interaction with other formwork components, according to one or more disclosed implementations.
Figure 3B:
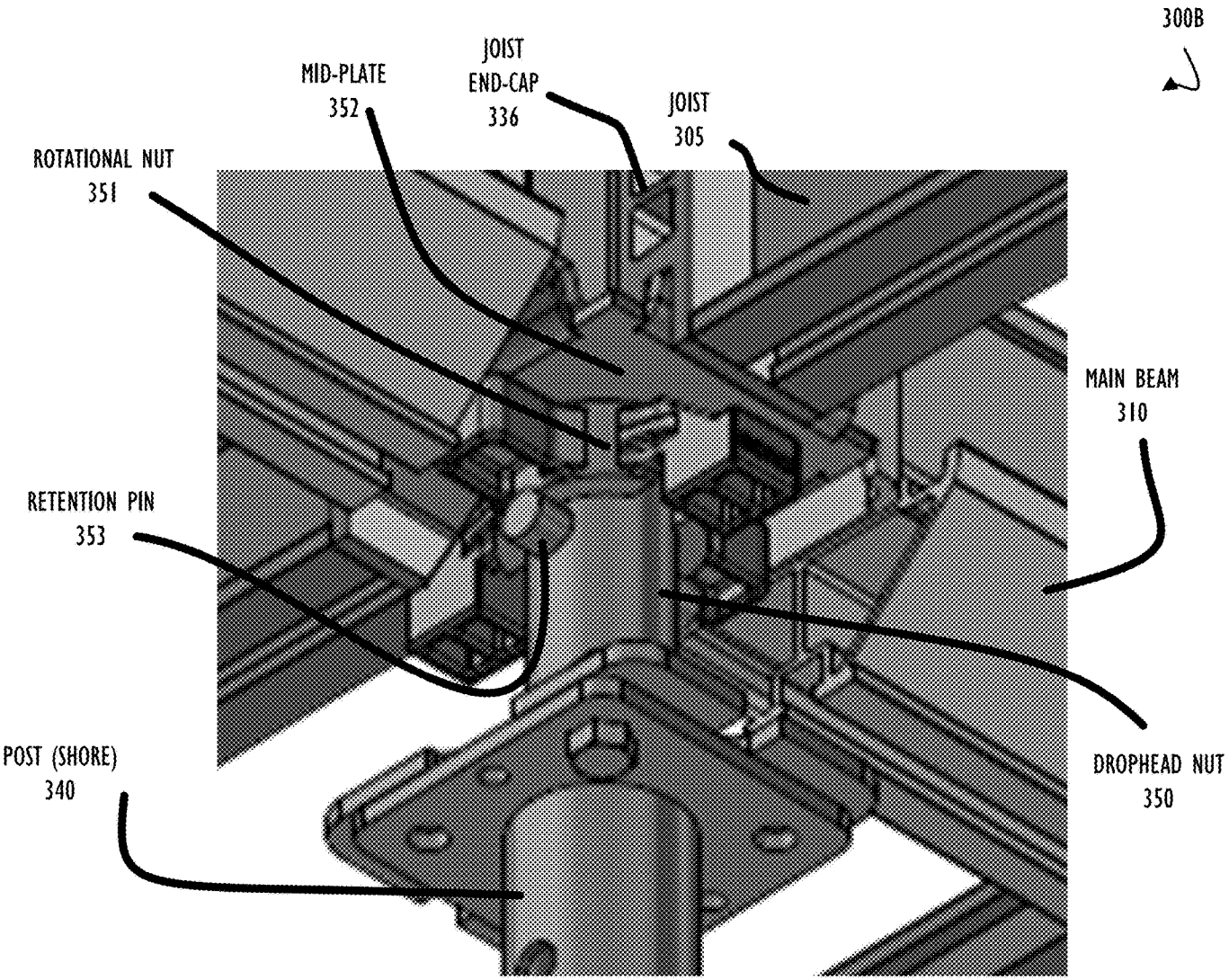
FIG. 3B illustrates an enlarged portion of FIG. 3A to enhance portions of a drophead nut, according to one or more disclosed embodiments.

Referring now to FIGS. 3A-3B, FIG. 3A illustrates a view of formwork grid system 300A to show several of the components discussed above configured to function together as an example of their use in construction. FIG. 3B illustrates an enlarged portion 300B of the view of formwork grid system 300A (enlarged to show more detail). The view provided in FIGS. 3A-3B of formwork grid system 300A and enlarged portion 300B is from below and includes decking 315 (not visible in the view but above respective beams) as the uppermost layer. Decking 315 is generally formed from plywood. As mentioned above, a configured formwork grid system 300A would support pouring of wet cement onto the decking layer opposite the side of decking 315 that rests (or is attached to) each of main beam 310 and joists 305 that are shown in FIG. 3A. Once that cement has cured some of the formwork components (e.g., main beams and joists) shown in FIG. 3A may be removed. This process is sometimes referred to as "stripping." In some cases, stripping removes all components except the prop and the drophead nut itself (e.g., the top of the drophead and prop are still providing support but main beams and joists have been "released" because the drophead nut has been disengaged to release upward pressure).

As illustrated in FIG. 3A, formwork grid system 300 includes a joist 305 that spans between two (or more) main beams 310 to support decking 315. Joists 305 and main beams 310 are shown "engaged" in the example of FIG. 3A. Engaged means that each joist 305 may include a joist end-cap 336 and main beam 310 would include a main beam end-cap 335 that would (if desired) align with a mid-plate lip (e.g., mid-plate lip 111 of FIG. 1 or mid-plate lip 161 of FIG. 2). This concept is illustrated here by main beam end-cap 335 which is shown "connected" to drophead nut 350 at a lip of mid-plate 352. Alternatively, each joist 305 may simply overlay (e.g., lay on top of) main beam 310. A combination of joists 305 and main beams 310 would collectively work to support a platform of what is typically a layer of plywood to form decking 315. Although plywood is used in this example as the material to be used for decking 315, other materials (e.g., metal or plastic) may be used to provide decking 315 support.

Concurrently referencing FIGS. 3A and 3B, a post (shore) 340 is illustrated that is directly below drophead nut 350. As explained above, the combination of post with drophead nut (e.g., drophead nut 150 of FIG. 2) provides vertical support for each main beam 310 and joists 305, that in turn support decking 315. To remove formwork grid system 300A (after curing of the cement layer above decking 315), rotational nut 351 (more easily seen in FIG. 3B) would be spun (rotated) enough to align its retention pin gap (not visible) with a retention pin 353 of drophead nut 350. As explained throughout this disclosure, rotation to disengage rotational nut 351 may be performed by striking an impact surface (e.g., impact surface 190) to effect rotation. Upon alignment of gaps with the retention pin 353, drophead nut 350 would change from an engaged position to a collapsed (disengaged) position with mid-plate 352 and rotational nut 351 dropping toward post 340 to release upward support on main beams 310 and joists 305 to allow for disassembly of formwork grid system 300A (e.g., stripping).

Figure 4B:
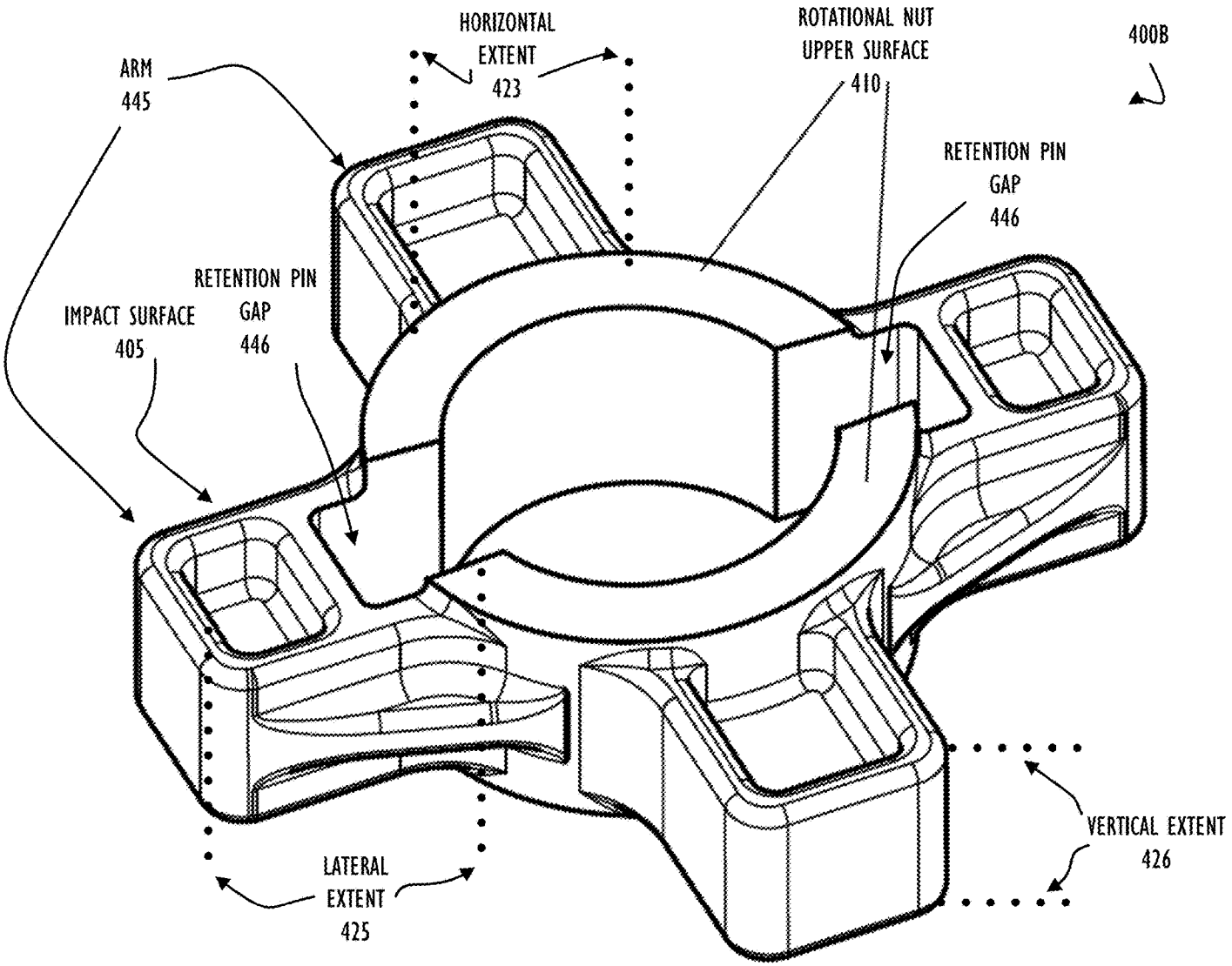
FIG. 4B (PRIOR ART)
FIGS. 4B-C illustrate alternative perspective views of the drophead nut of FIG. 1.
Figure 4C:
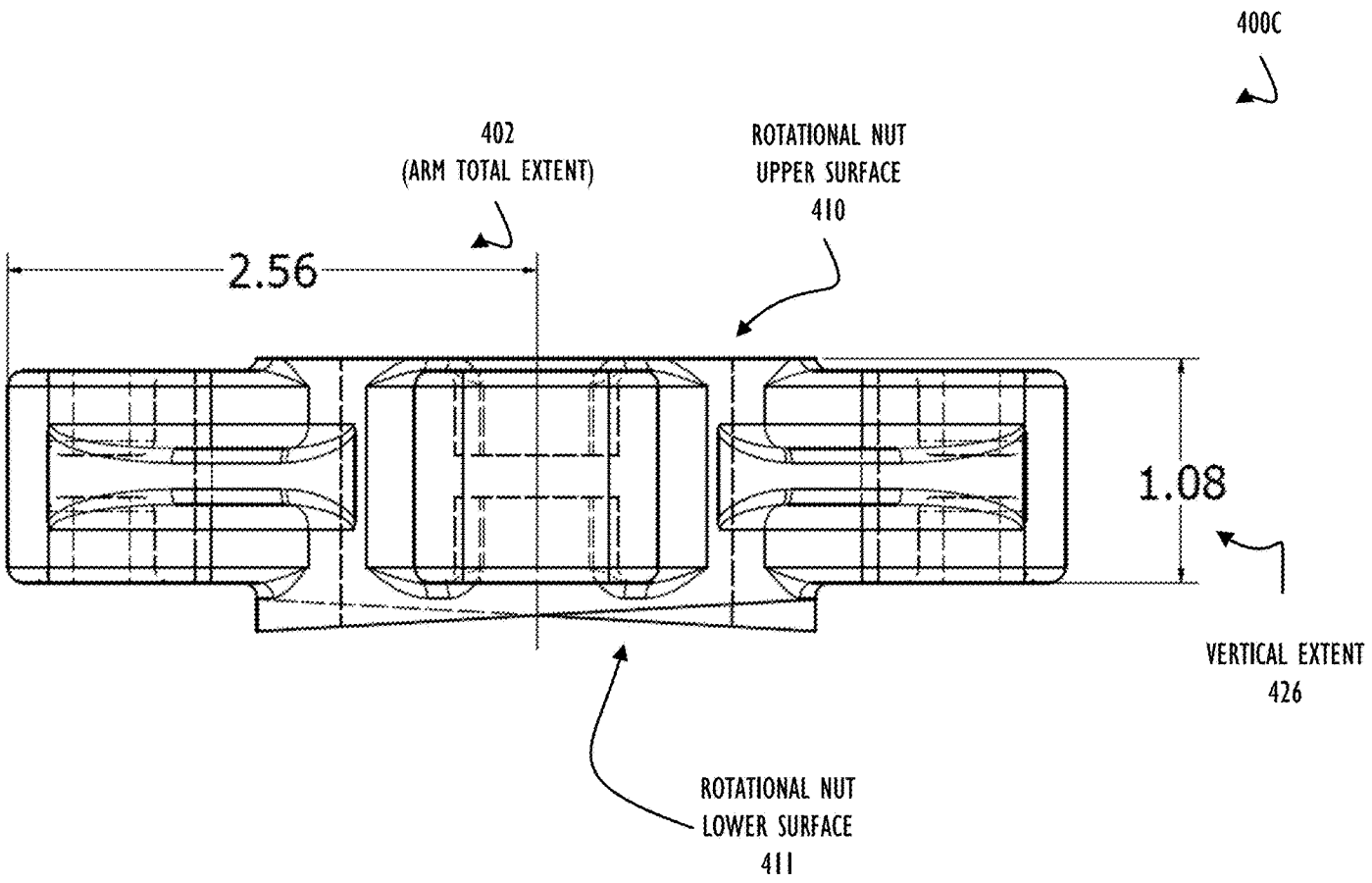
FIG. 4C (PRIOR ART)

Referring now to FIGS. 4A-C, a prior art rotational nut 440 is illustrated as part of a see-through view 400A from the top of a drophead nut (e.g., drophead nut 100 of FIG. 1). Rotational nut 440 includes the four arms 445 as mentioned above and two of the four arms each include a retention pin gap 446. Rotational nut 440 includes rotational nut lower surface 411 (shown in view 400C of FIG. 4C) that would contact a retention pin 435 (also shown as retention pin 125 of FIG. 1) to provide, via rotational nut upper surface 410 (FIG. 4C), support to a mid-plate 450 (also shown as mid-plate 110 of FIG. 1).

With reference to FIG. 4B that shows view 400B, in a prior art rotational nut 440, a lateral extent 425 of an arm is illustrated as spanning a distance away (lateral extent 435) from the circular center of rotational nut 440. A vertical extent 426, and a horizontal extent 423 are each illustrated for a respective one of the arms. In prior art systems, each arm 445 may have identical extents as the other three arms. An impact surface 405 is illustrated that conforms to the extents of arms 445 for prior art rotational nut 400. It is to be noted that horizontal extent 423 for rotational nut 440 has an equal interior horizontal extent and external horizontal extent (explained further below).

View 400A also shows mid-plate key gap 454, mid-plate lip 451, post 480, and mid-plate retention pin gap 453, which were discussed above. The arm total extent 402 is illustrated as being 2.56 inches and represents the distance in radius from a center of rotational nut 440 (i.e., a point in the center of post 480 when fully configured). Each of retention pin gap 446 and mid-plate retention pin gap 453 are illustrated to be at least 0.71 inches and substantially the same size as each other. In general, as explained above, each respective retention pin gap (i.e., mid-plate retention pin gap 453 and retention pin gap 446 of rotational nut 440) is sized to allow, upon alignment, passage of their corresponding component over retention pin 435 to disengage each of the rotational nut 440 and mid-plate 450 such that they "fall" toward a bottom plate (e.g., bottom plate 115 of FIG. 1) and release pressure of support for any other engaged (connected) components.

Finally, view 400C of FIG. 4C also shows that vertical extent 426 is largely consistent throughout rotational nut 440 (exception being slight inclines on rotational nut lower surface 411) and measures 1.08 inches for prior art rotational nuts. As can be seen in view 400C, rotational nut upper surface 410 is flat as to provide support for a mid-plate and rotational nut lower surface 411 may have a slight rotational incline to "lock" into place as part of rotation of the rotational nut 440 when rotated toward its engaged position. This incline helps to both lock rotational nut 440 into place when engaged and ease disengagement of rotational nut 440 when being rotated toward retention pin gap 446 alignment with retention pin 435 for release.

Referring now to FIGS. 5A-D, an improved rotational nut 540 and overall improved drophead nut (e.g., drophead nut 150 of FIG. 2) are illustrated in accordance with disclosed embodiments. In general, rotational nut 540 illustrates a variation and improvement over prior art rotational nut 440 because of several changed aspects. Additionally, other components (e.g., retention pin 555 size and strength) of drophead nut 150 of FIG. 2 are also explained throughout this disclosure to recognize the many improvements disclosed herein.

Figure 5A:
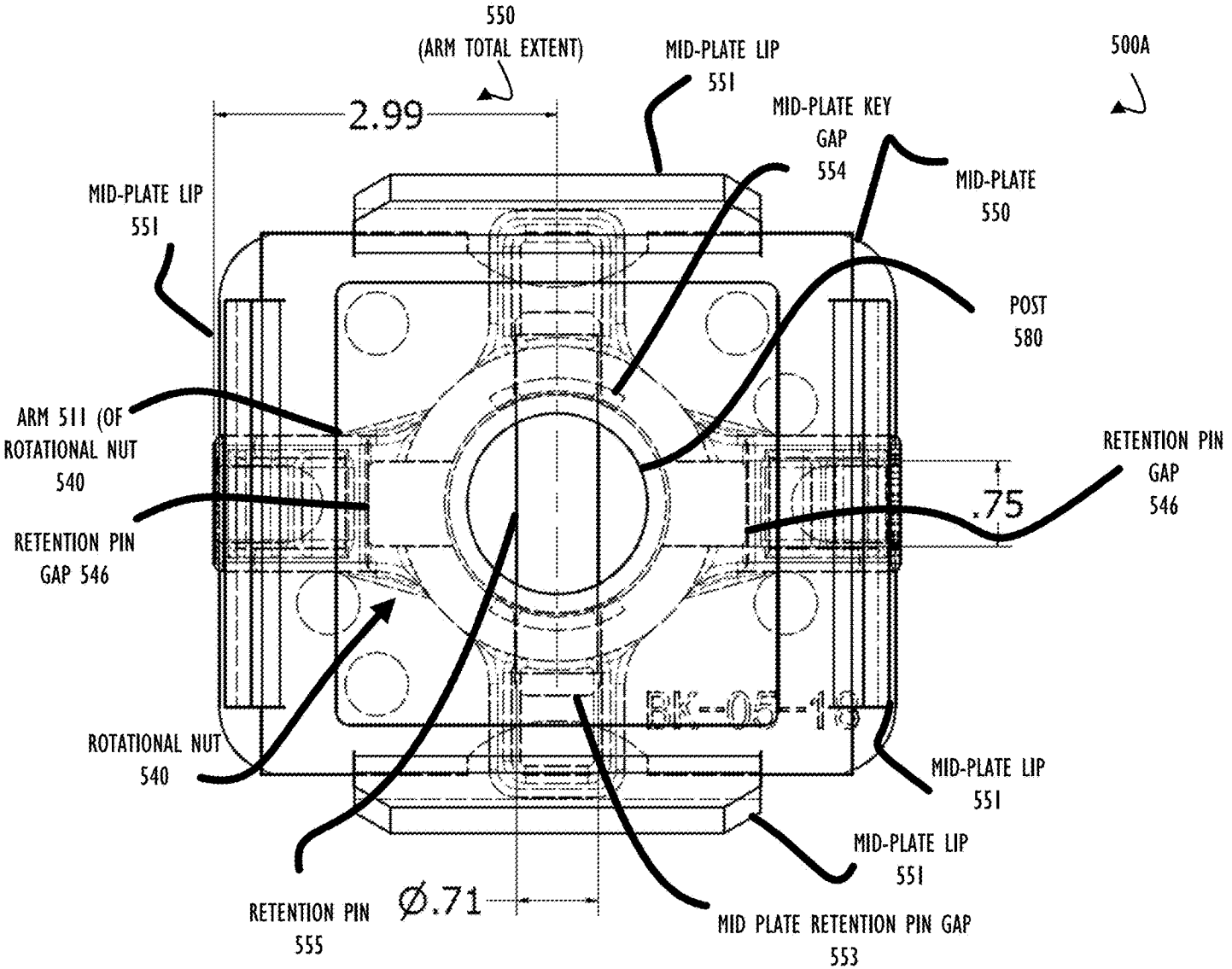
FIG. 5A illustrates a multi-layer view illustrating internal component interactions of the drophead nut of FIG. 2, according to one or more disclosed implementations.

Beginning with FIG. 5A, a see through view 500A is shown. In the view of 500A, there are four arms 511, where the two of the four arms 511 that include the retention pin gap 546 have been enhanced to further include an impact surface 515A (see FIG. 5B). View 500A illustrates that arm total extent 550 has been enlarged to 2.99 inches and retention pin gap 546 has been enlarged to 0.75 inches and retention pin 555 has been enlarged to 0.71 inches. Mid-plate retention pin gap 553 (not fully visible in FIG. 5A) has correspondingly been enlarged to pass over a corresponding retention pin 555. Mid-plate 550 includes four mid-plate lips 551 and a mid-plate gap key 554 as discussed above.

Figure 5B:
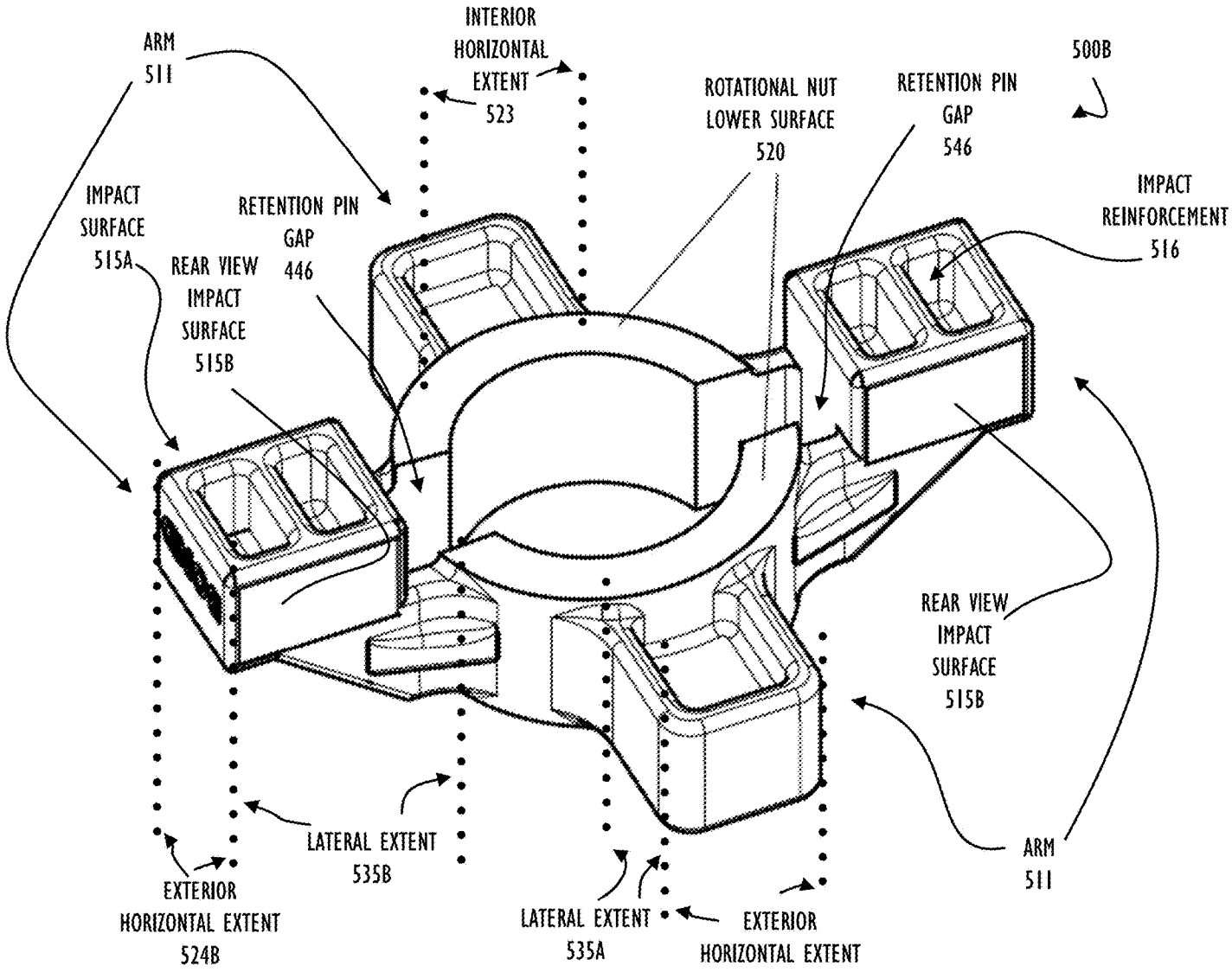
FIGS. 5B-D illustrate alternative perspective views of the drophead nut of FIG. 2, according to one or more disclosed implementations.

Referring now to FIG. 5B, two rear view impact surfaces 515B are illustrated and impact surface 515A is illustrated as being on the back side of each arm containing the enhancement for an impact surface. Rotational nut 540 includes rotational nut lower surface 520 that contacts with a retention pin 555 (from FIG. 5A) as explained above. Rotational nut 540 differs from prior art rotational nut 440 in several aspects. For example, lateral extent 535B for an arm containing an impact surface may be larger than lateral extent 535A for an arm not containing an impact surface. Behind an impact surface (on the bottom of a corresponding arm 511) there is illustrated an impact reinforcement 516.

The exterior horizontal extent 524B for an impact surface may be larger than the exterior horizontal extent 524A for arms that lack an impact surface. Additionally, for arms that lack an impact surface, the interior horizontal extent 523 may be equal to the exterior horizontal extent 524A. In contrast, the exterior horizontal extent 524B, for each arm containing an impact surface, may be larger than the corresponding interior horizontal extent for that same arm. This also means that exterior horizontal extent 524B (for in impact arm) may be larger than the exterior horizontal extent 524A (for a non-impact arm). In other embodiments that are not illustrated, all arms of a rotational nut may have an impact surface and/or include a larger exterior horizontal extent.

Further, as illustrated in FIG. 5B and further shown in each of FIGS. 5C-D, the impact surface 515A may extend below the rotational nut lower surface 520 (illustrated as rising above, because the view 500B of FIG. 5B illustrates the bottom of rotational nut 540). In summary, the impact surface of the improve rotational nut 540 is larger, extends further out from the circular interior, and extends downward to allow for easier access by workers. Additionally, location of the impact surface improves leverage to disengage (e.g., to properly release even when supporting substantially more weight than prior art drophead nuts).

Figure 5C:
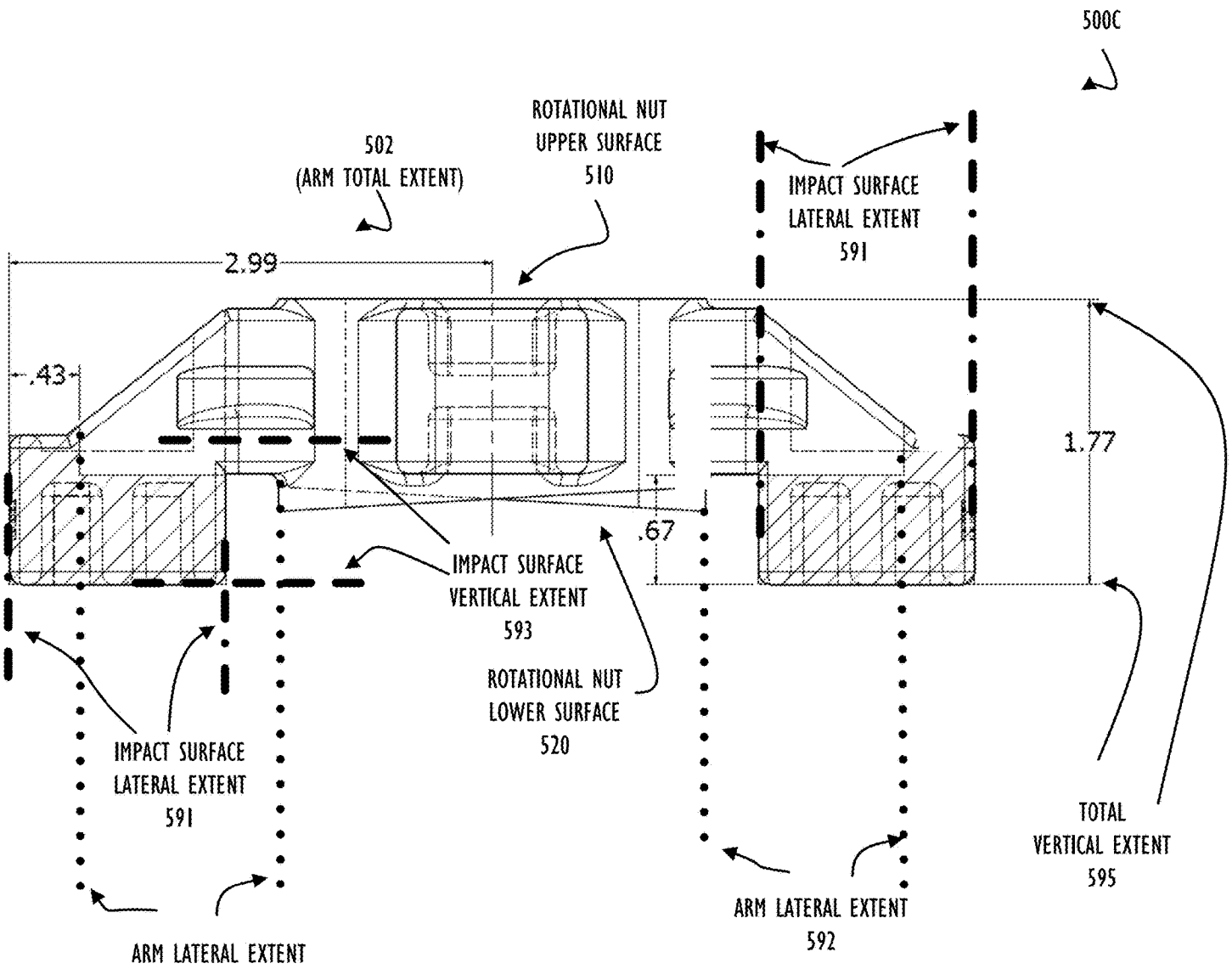

Referring now to FIG. 5C, a side view 500C of rotational nut 540 in accordance with this disclosure is illustrated. Specifically, side view 500C and side view 500D (of FIG. 5D) illustrate rotational nut 540 from different perspectives. As explained above, and illustrated now for rotational nut 540, the impact surface vertical extent 593 is larger than prior art systems and extends below the lower surface of the drophead nut. The impact surface lateral extent 591 may be enlarged and positioned at the circumferential extreme of arm lateral extent 592. Further, the impact surface lateral extent 591 may extend beyond the arm lateral extent 592. In short, the impact surface has been enlarged in multiple directions. The improved impact surface has been extended laterally and vertically such that it is further away from center and lower than the impact surface of prior art rotational nuts that had their impact surface within the each of the extents a) lateral, b) vertical, and c) horizontal, of the arms themselves.

As illustrated in the example embodiment shown for side view 500C, a total vertical extent 595 has been increased to 1.77 inches and allows an impact surface (e.g., impact surface 515A) to extend approximately 0.67 inches below a rotational nut lower surface 520 and 1.77 inches below rotational nut upper surface 510. For side view 500C, it is illustrated that a portion of the increased arm total extent 502 (2.99 inches in this example) may include an extra 0.43 inches attributable to extension beyond arm lateral extent 592 and an outer most portion of impact surface lateral extent 591.

Figure 5D:
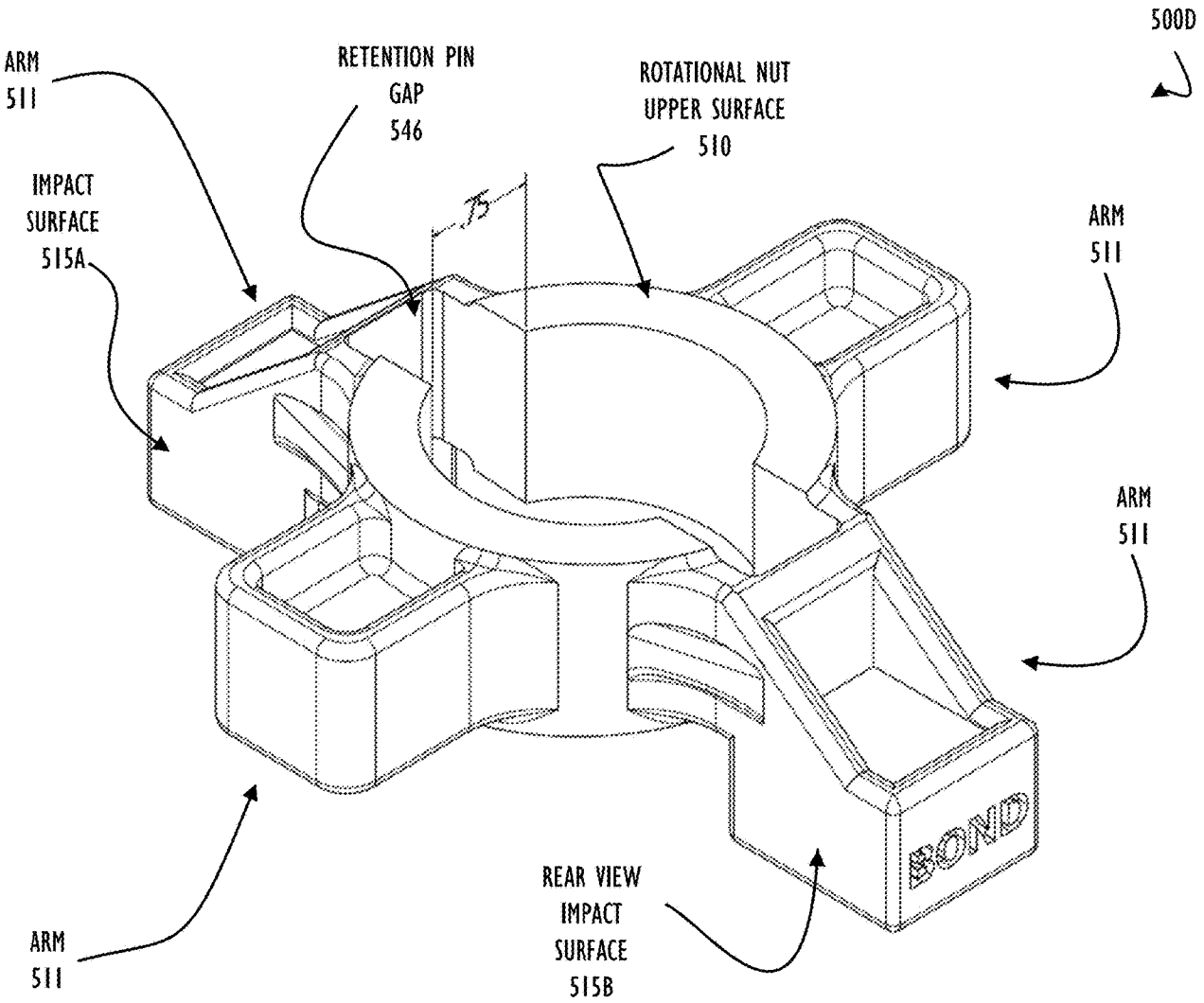

Finally, FIG. 5D illustrates side view 500D. In this view, retention pin gap 546 is shown to be 0.75 inches. Differences between arms 511 that include impact surface 515A and arms 511 that do not include impact surfaces 515A are also visible. These differences have been discussed above and are not elaborated further here.

While the embodiments are described with reference to various implementations and exploitations, it will be understood that these embodiments are illustrative and that the scope of the inventive subject matter is not limited to specifically disclosed implementations. Many variations, modifications, additions, and improvements are possible. Additionally, the specific measurements disclosed herein may represent a minimum size as larger sizes may also recognize the benefits of the improvements disclosed herein.

Plural instances may be provided for components, operations, or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

Certain terms have been used throughout this description and claims to refer to particular system components. As one skilled in the art will appreciate, different parties may refer to a component by different names. This document does not intend to distinguish between components that differ in name but not function. In this disclosure and claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first component couples to a second component, that coupling may be through a direct connection or through an indirect connection via other components and connections. In this disclosure a direct connection will be referenced as a "connection" rather than a coupling. The recitation "based on" is intended to mean "based at least in part on." Therefore, if X is based on Y, X may be a function of Y and any number of other factors.

The above discussion is meant to be illustrative of the principles and various implementations of the present disclosure. Numerous variations and modifications will become apparent to those skilled in the art once the above disclosure is fully appreciated. It is intended that the following claims be interpreted to embrace all such variations and modifications.

What is claimed is:

1. A rotational nut for a drophead nut used in formwork grid systems, the rotational nut comprising:

a body defining a central circular opening sized to accommodate a drophead post;

four laterally extending arms extending laterally from the body;

a first arm and a second arm of the four laterally extending arms defining a retention pin gap, the retention pin gap sized sufficiently to allow, upon alignment of the retention pin gap with a retention pin of the drophead post, passage of the rotational nut past the retention pin;

a first impact surface positioned on the first arm; and a second impact surface positioned on the second arm, wherein:

the first arm defines a first external radial circumference relative to the central circular opening and has a first lateral extent and a first vertical extent; and the first impact surface of the first arm is positioned on the first arm at the first external radial circumference of the first arm such that the first impact surface is positioned at an end of the first arm most distal to the central circular opening and the first impact surface has:

a first impact surface lateral extent extending beyond the first lateral extent of the first arm such that the first impact surface extends beyond the end of the first arm most distal to the central circular opening; and a first impact surface vertical extent extending below the first vertical extent of the first arm such that the first impact surface extends below the end of the first arm most distal to the central circular opening and extends below the lower surface of the body of the rotational nut.

2. The rotational nut of claim 1, wherein:

the second arm defines a second external radial circumference relative to the central circular opening and has a second lateral extent and a second vertical extent; and the second impact surface of the second arm is positioned at the second external radial circumference of the second arm such that the second impact surface is positioned at an end of the second arm most distal to the central circular opening and the second impact surface has:

a second impact surface lateral extent extending beyond the second lateral extent of the second arm such that the second impact surface extends beyond the end of the second arm most distal to the central circular opening; and a second impact surface vertical extent extending below the second vertical extent of the second arm such that the second impact surface extends below the end of the second arm most distal to the central circular opening.

3. The rotational nut of claim 1, wherein the first arm is positioned on the body opposite the second arm.

4. The rotational nut of claim 1, wherein the first arm includes an impact reinforcement behind the first impact surface.

5. The rotational nut of claim 4, wherein the second arm includes an impact reinforcement behind the second impact surface.

6. The rotational nut of claim 1, wherein a third arm and a fourth arm of the four laterally extending arms do not include a respective impact surface and do not define a second retention gap opening.

7. The rotational nut of claim 6, wherein the first arm and the second arm are positioned on the body opposite each other and the third arm and the fourth arm are positioned on the body opposite each other and between each of the first arm and the second arm.

8. The rotational nut of claim 7, wherein the four laterally extending arms are symmetrically positioned on the body about the rotational nut to form a cross having equidistant space between each of the four laterally extending arms.

9. The rotational nut of claim 1, wherein the four laterally extending arms are symmetrically positioned about the rotational nut to form a cross.

10. A drophead nut for use in a formwork grid system, the drophead nut comprising:

a rotational nut including:

a body defining a central circular opening;

four arms, each of the four arms extending laterally from the body;

and a retention pin gap in a first arm and a second arm of the four arms;

a top plate;

a bottom plate;

a post extending between the top plate and the bottom plate and passing through the central circular opening of the rotational nut;

a retention pin extending from at least two sides of the post at a midpoint between the top plate and the bottom plate;

a mid-plate defining a mid-plate central opening and a mid-plate retention pin gap, the mid-plate positioned adjacent to the rotational nut nearer the top plate, the post passing through the mid-plate central opening, and the mid-plate defining a plurality of mid-plate lips, each mid-plate lip associated with a corresponding edge of the mid-plate, wherein the retention pin gap of the rotational nut and the mid-plate retention pin gap are each sufficiently sized to, upon alignment of each respective retention pin gap with the retention pin, passage of the rotational nut and the mid-plate past the retention pin, and wherein the rotational nut further comprises:

a first arm and a second arm of the four arms;

a first impact surface positioned on the first arm; and a second impact surface positioned on the second arm, and wherein:

the first arm defines a first external radial circumference relative to the central circular opening and has a first lateral extent and a first vertical extent; and the first impact surface of the first arm is positioned on the first arm at the first external radial circumference of the first arm such that the first impact surface is positioned at an end of the first arm most distal to the central circular opening and the first impact surface has:

a first impact surface lateral extent extending beyond the first lateral extent of the first arm such that the first impact surface extends beyond the end of the first arm most distal to the central circular opening; and a first impact surface vertical extent extending below the first vertical extent of the first arm such that the first impact surface extends below the end of the first arm most distal to the central circular opening and extends below the lower surface of the body of the rotational nut.

11. The drophead nut of claim 10, wherein each mid-plate lip is associated with an associated main beam or joist beam of a formwork system such that the retention pin supports the mid-plate that, when the drophead nut is engaged, supports the associated main beam or joist beam, and when dis-engaged via passage past the retention pin, releases support for the associated main beam or joist beam.

12. The drophead nut of claim 10, wherein: the second arm defines a second external radial circumference relative to the central circular opening and has a second lateral extent and a second vertical extent; and the second impact surface of the second arm is positioned at the second external radial circumference of the second arm such that the second impact surface is positioned at an end of the second arm most distal to the central circular opening and the second impact surface has:

a second impact surface lateral extent extending beyond the second lateral extent of the second arm such that the second impact surface extends beyond the end of the second arm most distal to the central circular opening; and a second impact surface vertical extent extending below the second vertical extent of the second arm such that the second impact surface extends below the end of the second arm most distal to the central circular opening.

13. The drophead nut of claim 10, wherein:

the retention pin is at least 18 millimeters in diameter;

the retention pin gap is at least 19 millimeters across; and the retention pin has a shear strength above 20,000 pounds.

14. The drophead nut of claim 10, wherein the first arm includes an impact reinforcement behind the first impact surface.

15. The drophead nut of claim 14, wherein the second arm includes an impact reinforcement behind the second impact surface.

16. The drophead nut of claim 10, wherein a third arm and a fourth arm of the four arms do not include an associated impact surface or opening as the retention gap opening.

17. The drophead nut of claim 16, wherein the first arm and the second arm are positioned on the body opposite each other and the third arm and the fourth arm are positioned on the body opposite each other and between each of the first and second arms.

18. The drophead nut of claim 17, wherein the four arms are symmetrically positioned about the rotational nut to form a cross.

19. The drophead nut of claim 10, wherein the four arms are symmetrically positioned about the rotational nut to form a cross.

20. A rotational nut for a drophead nut used in formwork grid systems, the rotational nut comprising:

a body defining a central circular opening sized to accommodate a drophead post;

a first arm laterally extending from the body, the first arm having a first lateral extent and a first vertical extent, the first arm defining a first impact surface, the first impact surface positioned on the first laterally extending arm at a first external radial circumference of the first arm most distal to the central circular opening, the first impact surface having:

a first impact surface lateral extent extending beyond the first lateral extent of the first arm such that the first impact surface is positioned at an end of the first arm most distal to the central circular opening; and a second impact surface vertical extent extending below the first vertical extent of the first arm such that the first impact surface extends below the end of the first arm most distal to the central circular opening and extends below the lower surface of the body of the rotational nut;

a second arm laterally extending from the body, the second arm having a second lateral extent and a first vertical extent, the second arm defining a second impact surface, the first arm and the second arm defining a retention pin gap of at least 19 millimeters, the retention pin gap sized sufficiently to allow, upon alignment of the retention pin gap with a retention pin of a drophead post, passage of the rotational nut past the retention pin;

a third arm laterally extending from the body; and a fourth arm laterally extending from the body.

* * * * *